US008038004B2

(12) United States Patent
Hu

(10) Patent No.: US 8,038,004 B2
(45) Date of Patent: Oct. 18, 2011

(54) COMPACT TOOL BOX WITH RATCHET DRIVING FUNCTION

(76) Inventor: Bobby Hu, Taichung (TW)

( * ) Notice: Subject to any disclaimer, the term of this patent is extended or adjusted under 35 U.S.C. 154(b) by 0 days.

(21) Appl. No.: 12/891,861

(22) Filed: Sep. 28, 2010

(65) Prior Publication Data

US 2011/0120895 A1 May 26, 2011

(30) Foreign Application Priority Data

Nov. 25, 2009 (TW) ..... 98222066 U

(51) Int. Cl.
*B65D 85/28* (2006.01)

(52) U.S. Cl. ..... 206/375; 81/177.4; 81/490; 206/372; 206/379

(58) Field of Classification Search ..... 206/372–379, 206/234, 758, 763, 765; 7/165; 16/111.1; 81/177.4, 438, 439, 490; 211/70.6
See application file for complete search history.

(56) References Cited

U.S. PATENT DOCUMENTS 5,535,882 A * 7/1996 Liu ..... 206/377
6,050,409 A * 4/2000 Delbeck et al. ..... 206/375
6,216,858 B1 * 4/2001 Chiu ..... 206/234
6,243,902 B1 6/2001 Huang ..... 7/165
6,405,865 B1 6/2002 Lin ..... 206/379
6,988,616 B2 * 1/2006 Chen ..... 206/379
7,032,483 B2 4/2006 Liu ..... 81/490
7,168,559 B2 * 1/2007 Chen ..... 206/373
2006/0016706 A1 * 1/2006 Chen ..... 206/379
2006/0118446 A1 * 6/2006 Liu ..... 206/373
2009/0255840 A1 * 10/2009 Lin ..... 206/379

* cited by examiner

*Primary Examiner* — Luan K Bui
(74) *Attorney, Agent, or Firm* — Alan Kamrath; Kamrath & Associates PA

(57) ABSTRACT

A tool box includes a body having a front end and a force-receiving portion spaced from the front end. The body further includes first and second sides and two lateral walls. The front end includes a driving groove for receiving a shank in an operative position. A receiving space is defined between the lateral walls and has an opening. The force-receiving portion includes an insertion groove for receiving the shank in a storage position. The insertion groove is in communication with the driving groove of the body. The body further includes a first opening extending from one of the lateral walls through the insertion groove and a second opening extending from the other lateral wall through the insertion groove, allowing access to the shank in the storage position for manual removal of the shank from the insertion groove. A bit-receiving rack is removably received in the receiving space.

12 Claims, 13 Drawing Sheets

COMPACT TOOL BOX WITH RATCHET DRIVING FUNCTION

BACKGROUND OF THE INVENTION

The present invention relates to a compact tool box with ratcheting driving function and, more particularly, to a tool box that can be used in a corner of a wall and that is small in size while providing a force-saving driving effect.

U.S. Pat. No. 6,243,902 discloses a tool handle combination including a driving stem mounted to a handle body. The handle body has a base and a cover mounted on top of the base. The cover and the base together define a space for receiving bits, sockets or other tools. Such a tool handle combination is not easy to carry due to the considerable length of the driving stem. The objects received in the spaced result in a substantially cubic handle body that can not be effectively reduced in width or height. A user can apply a force along the longitudinal axis of the driving stem to engage the bit with a workpiece such as a screw. Furthermore, the user can apply a force in a clockwise or counterclockwise direction for rotating the driving stem about the longitudinal axis. However, the force applied by the user is limited, because the width and the height of the handle body are approximately the same. Namely, rotating the tool handle combination is laborsome. Furthermore, the repeatedly openable cover can not effectively transmit the force applied by the user. Further, the cover is liable to slide relative to the base or to deform when the user intends to apply large torque, leading to loss of kinetic energy during transmission. As a result, the user often feels difficulty during operation. In worse conditions, the handle body could be damaged by the large torque.

U.S. Pat. No. 6,405,865 discloses a tool box including a body and a cap movably mounted to the body. The body includes a board and a post extending from the board. A plurality of passages is defined through the post for receiving long bits and bits. An engaging recess is defined in a distal end of the post for selectively receiving a long bit or a bit. When not in use, the long bit can be removed from the engaging recess and stored in one of the passages, allowing easy carriage. The passages extend perpendicularly through two sides of the post in a lateral direction, and the cover houses the post. Thus, the overall width extends in the lateral direction to reduce the profile of the overall tool box, providing a pocket-size or compact tool box. However, the user has to detach the cap from the body before retrieving the long bit, resulting in inconvenience to use and in waste of time particularly to a worker frequently using the tool box and adversely affecting the marketing value. Further, the repeatedly removable cap can not effectively transmit the force applied by the user. Furthermore, the cover is liable to slide relative to the body or to deform when the user intends to apply large torque, leading to loss of kinetic energy during transmission. As a result, the user often feels difficulty during operation. In worse conditions, the body could be damaged by the large torque.

U.S. Pat. No. 7,032,483 discloses a toolbox driver including a base, a first bracket pivotally mounted to a side of the base, and a second bracket pivotally mounted to the other side of the base spaced from the side of the base in a lateral direction. The second base receives a plurality of screwdriver heads. The base includes an insertion hole for engaging with a screwdriver rod when in use. The first bracket includes a receptacle hole for receiving the screwdriver rod when not in use, allowing easy carriage. The width of the overall tool box extends in the lateral direction to reduce the height of the tool box, providing a pocket-size or compact tool box. However, the user has to open the second bracket before retrieving the screwdriver rod, resulting in inconvenience to use and in waste of time particularly to a worker frequently using the tool box and adversely affecting the marketing value. Further, the repeatedly pivotable first and second brackets can not effectively transmit the force applied by the user. Furthermore, the first or second bracket is liable to slide relative to the base or to deform when the user intends to apply large torque, leading to loss of kinetic energy during transmission. As a result, the user often feels difficulty during operation. In worse conditions, the base could be damaged by the large torque. Further, even though the receptacle hole of the first bracket is located adjacent to the side of the base, rotation of the toolbox is not smooth when driving a screw in a limited space such as a corner of a wall, because the user has to repeatedly disengage the screwdriver head from the screw and reengage with the screwdriver with head the screw. Further, the receptacle hole has differing spacings to the edges of the base, leading to limitation to the use of the toolbox.

Thus, a need exists for a compact tool box that can be used in a corner of a wall and that is small in size while providing a force-saving driving effect.

BRIEF SUMMARY OF THE INVENTION

The present invention solves this need and other problems in the field of compact tool boxes with reliable operation by providing, in a preferred form, a tool box including a body having a front end and a force-receiving portion spaced from the front end in a first direction. The body further includes first and second sides spaced in a second direction perpendicular to the first direction. The body further includes first and second lateral walls spaced in a third direction perpendicular to the first and second directions and extending between the front end and the force-receiving portion. The front end includes a driving groove. The driving groove is adapted to receive a shank in an operative position. The force-receiving portion includes an insertion groove extending in the first direction. The insertion groove is adapted to receive the shank in a storage position. The insertion groove is in communication with the driving groove of the body. The body includes a first opening extending from the first lateral wall through the insertion groove in the third direction. The body further includes a second opening extending from the second lateral wall through the insertion groove in the third direction. The first and second openings allow access to the shank in the storage position for manual removal of the shank from the insertion groove by fingers of a user. A receiving space is defined between the first and second lateral walls and has an opening. A rack is removably received in the receiving space of the body via the opening. The rack is adapted to receive a plurality of bits.

In preferred forms, the first and second openings are in communication with the second section of the insertion groove and have the same length in the first direction.

In preferred forms, a first maximum dimension of the body in the first direction between the front end and the force-receiving portion defines a first spacing. A second maximum dimension of the body in the second direction between the first and second sides defines a second spacing. A third maximum dimension of the body in the third direction between the first and second lateral walls defines a third spacing. The third spacing is smaller than the second spacing. The second spacing is smaller than the first spacing. The body has a first radius and a second radius in the second direction and having the same rotating axis. The first radius is equal to a spacing between the first side of the body and the rotating axis in the second direction. The second radius is equal to a spacing between the second side of the body and the rotating axis in the second direction. The second spacing is equal to a sum of the first radius and the second radius. The second radius is larger than the first radius. The first radius is smaller than the third spacing and preferably not larger than a half of the third radius. The rotating axis of the ratchet wheel has equal spacing to the first and second lateral walls in the third direction. Thus, the tool box can be used in a limited space such as a corner of a wall for large-angle driving.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
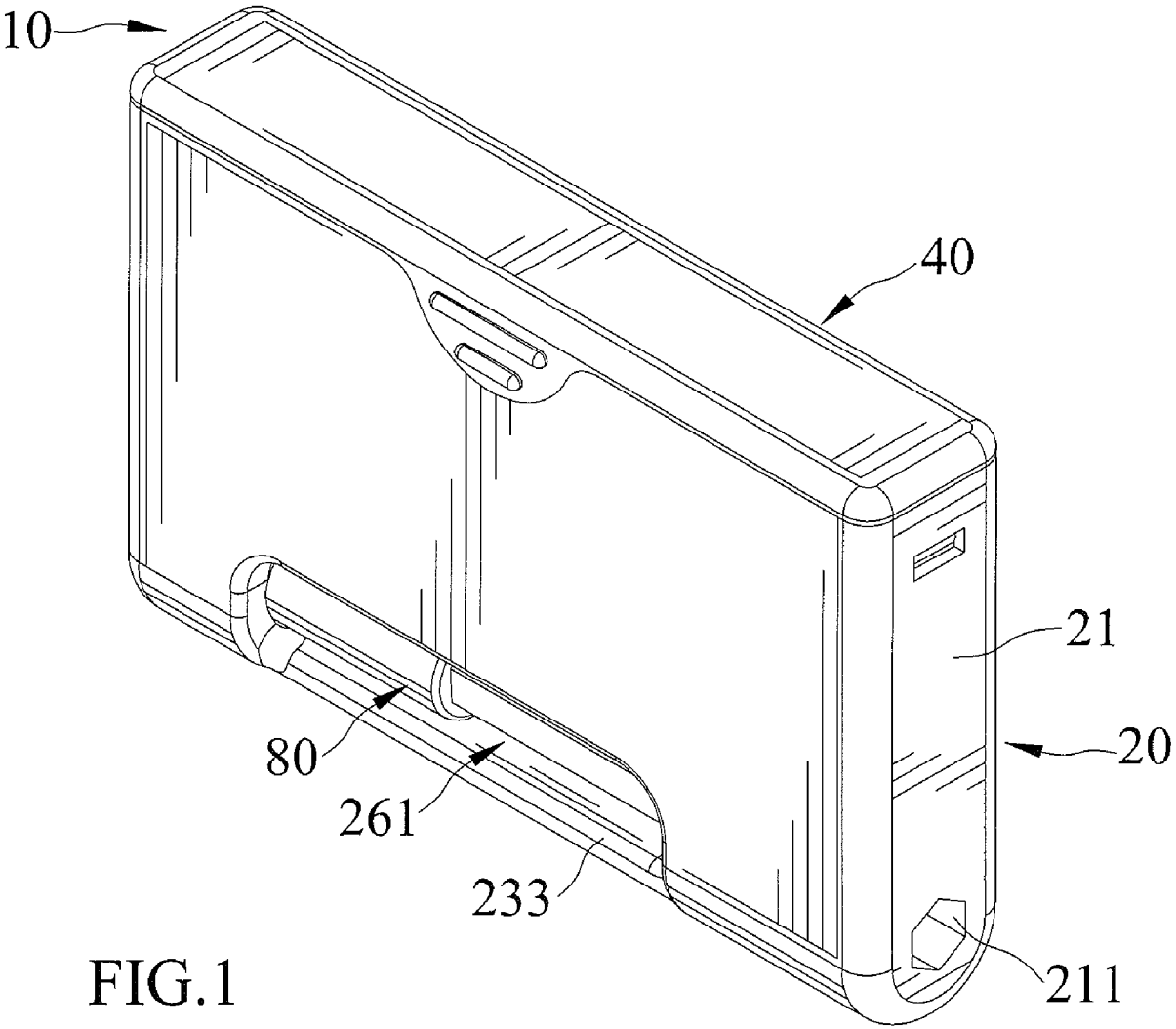
FIG. 1 shows a perspective view of a compact tool box of a first embodiment according to the preferred teachings of the present invention.
Figure 2:
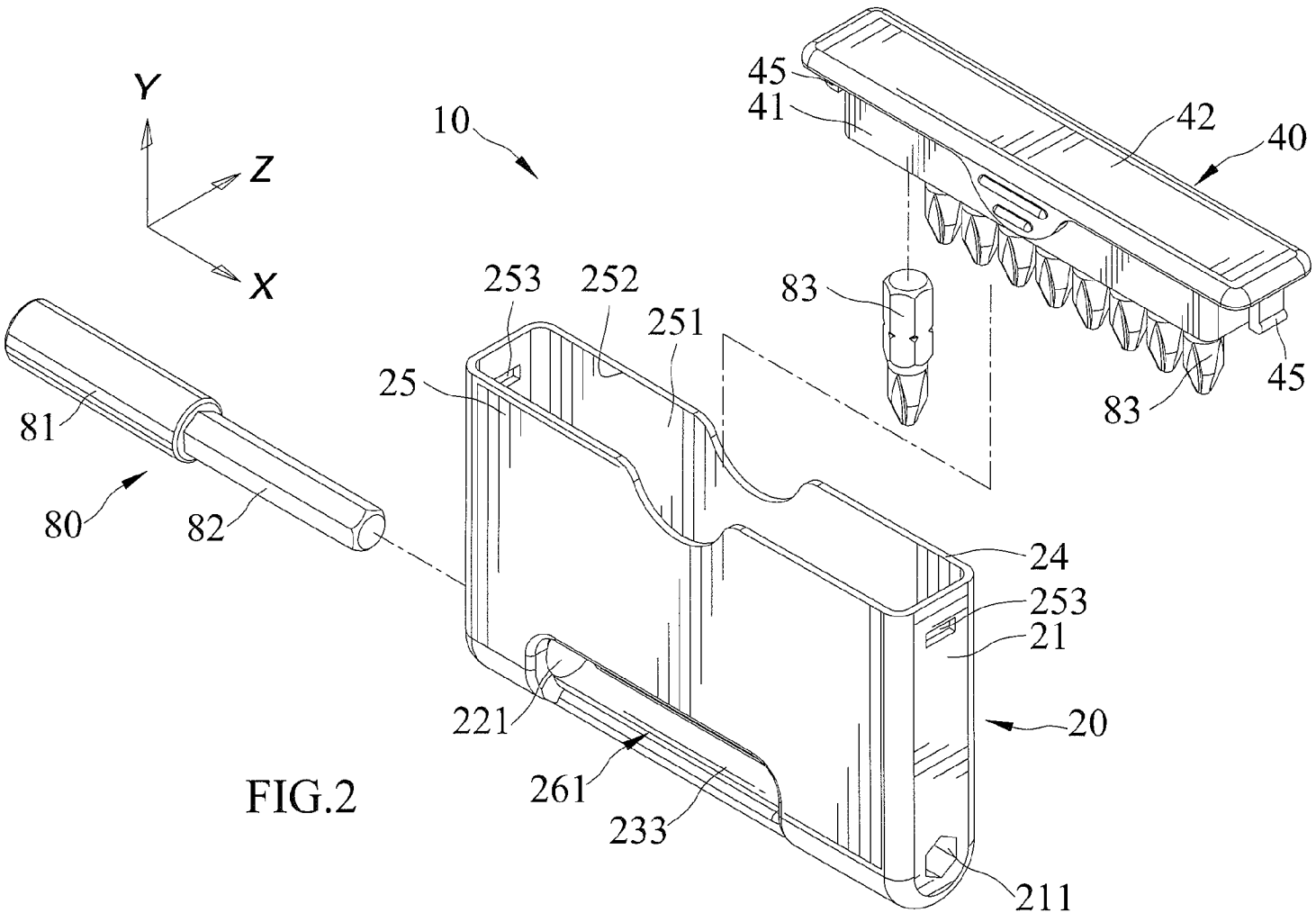
FIG. 2 shows an exploded, perspective view of the compact tool box of FIG. 1.
Figure 3:
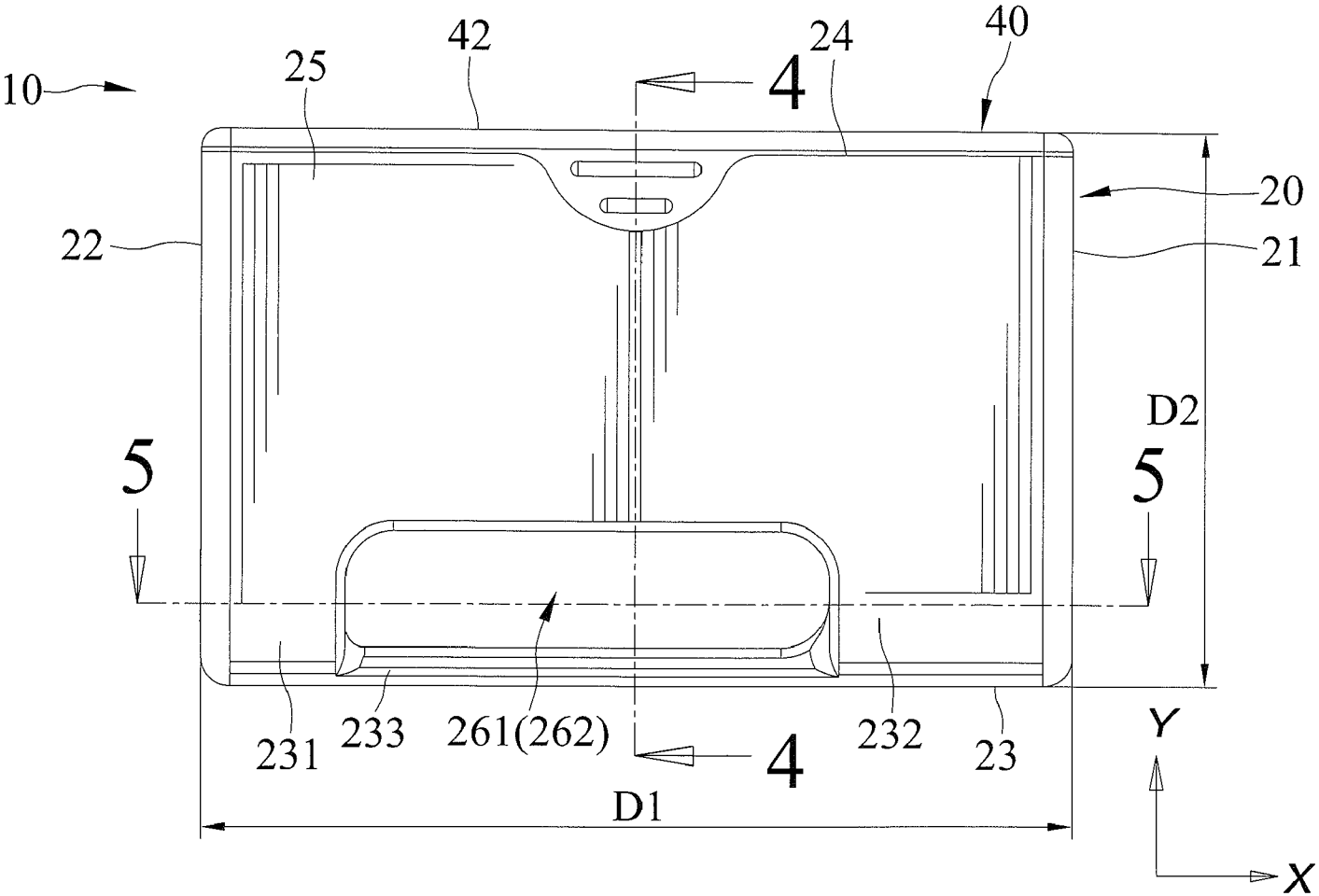
FIG. 3 shows a side view of the compact tool box of FIG. 1.
Figure 4:
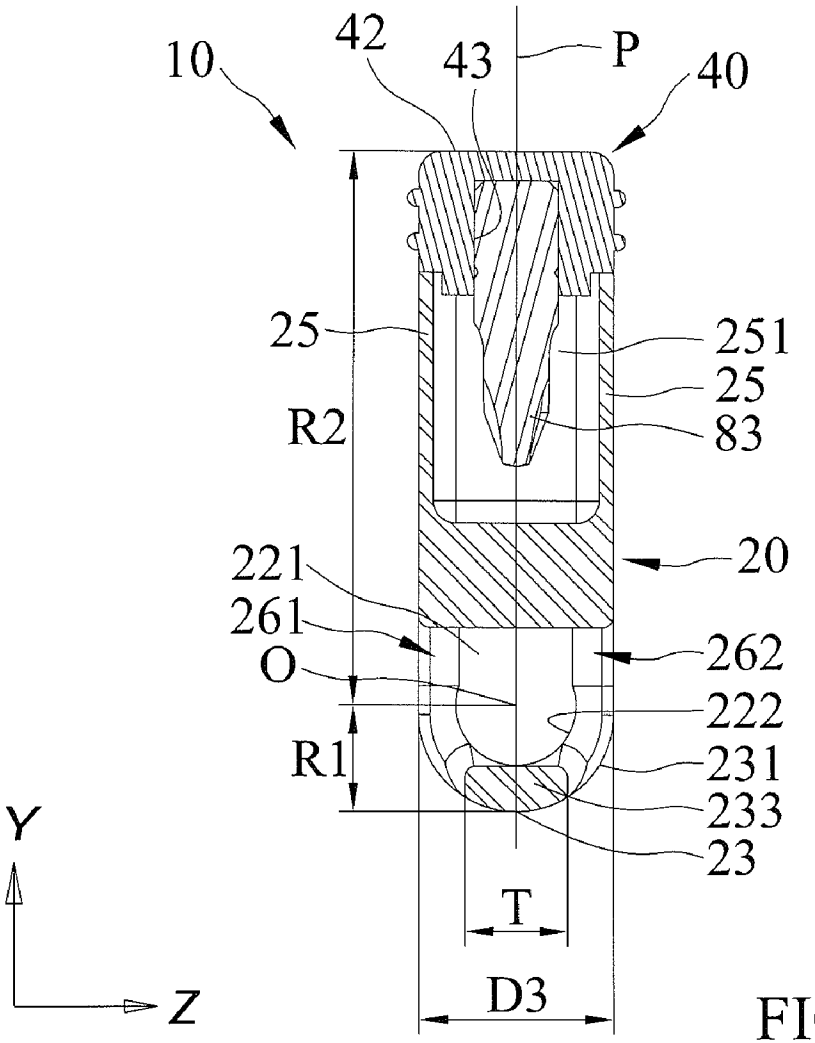
FIG. 4 shows a cross sectional view of the compact tool box of FIG. 1 according to section line 4-4 of FIG. 3.
Figure 5:
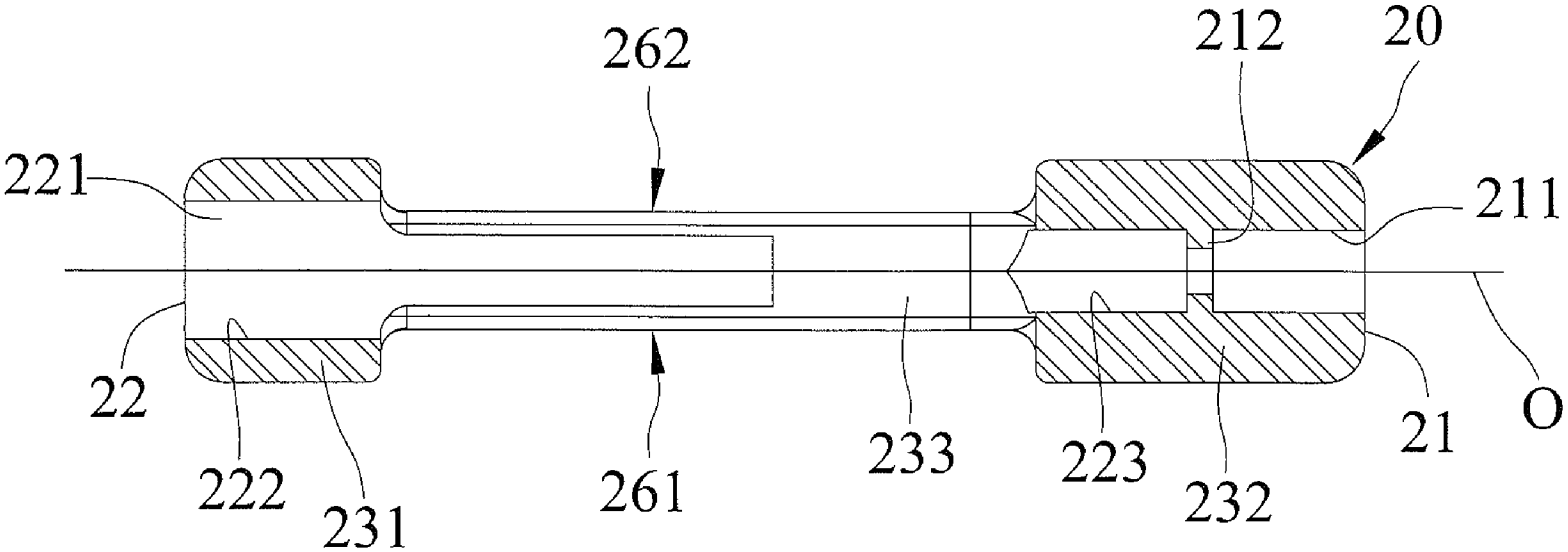
FIG. 5 shows a cross sectional view of the compact tool box of FIG. 1 according to section line 5-5 of FIG. 3.
Figure 6:
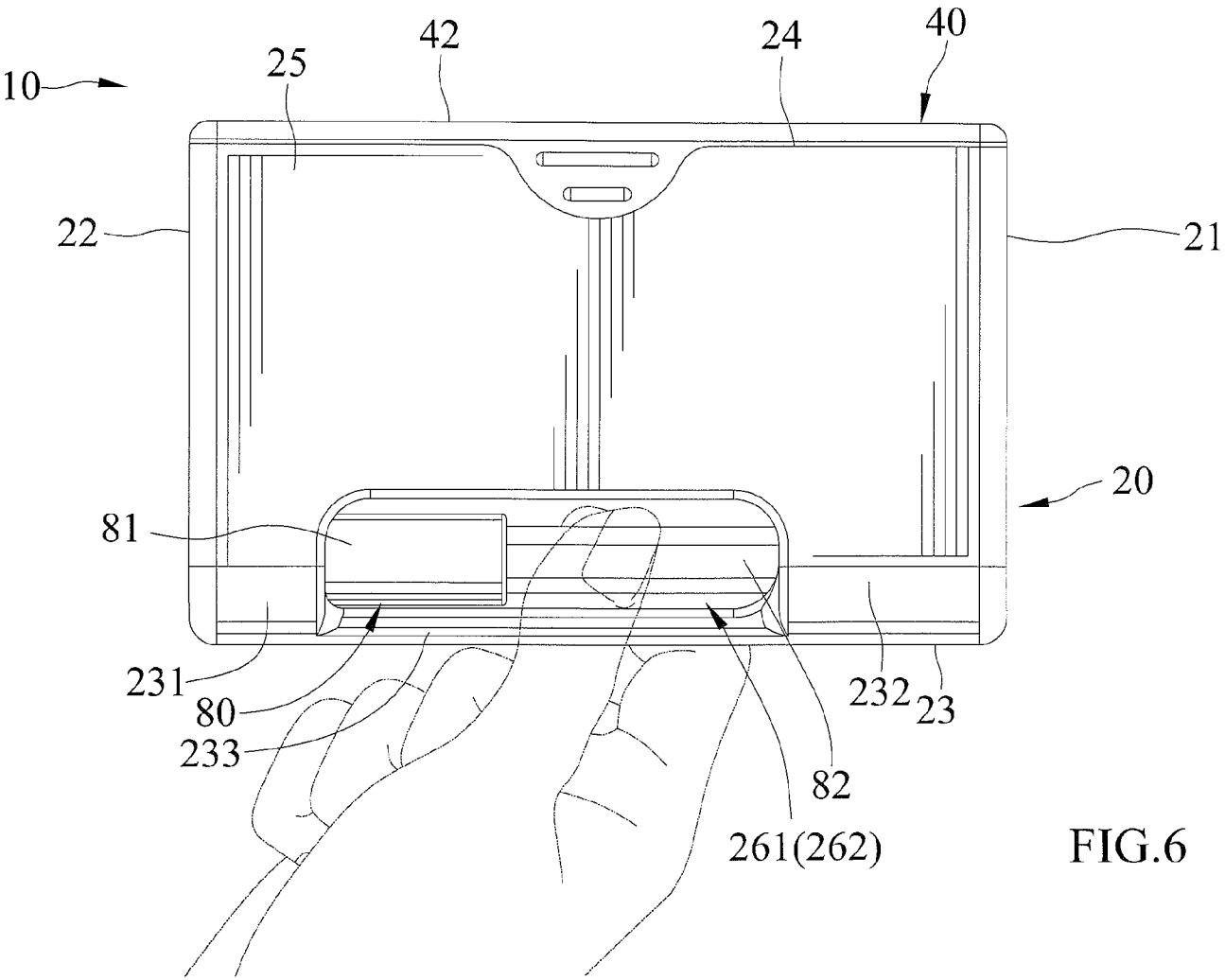
FIG. 6 shows a side view of the compact tool box of FIG. 1, illustrating removal of a shank from an insertion groove.
Figure 7:
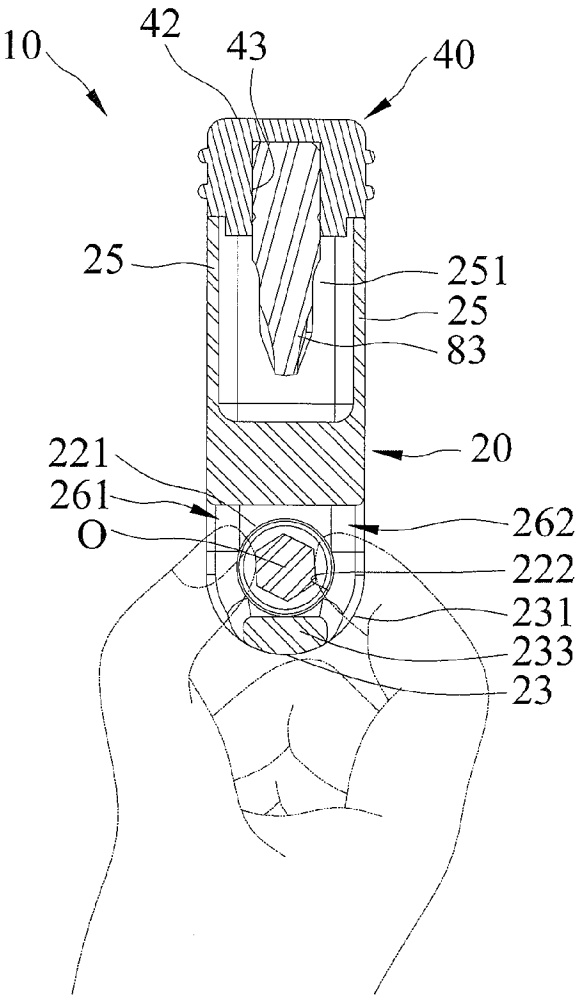
FIG. 7 shows a cross sectional view of the compact tool box of FIG. 1, illustrating removal of the shank from the insertion groove.
Figure 8:
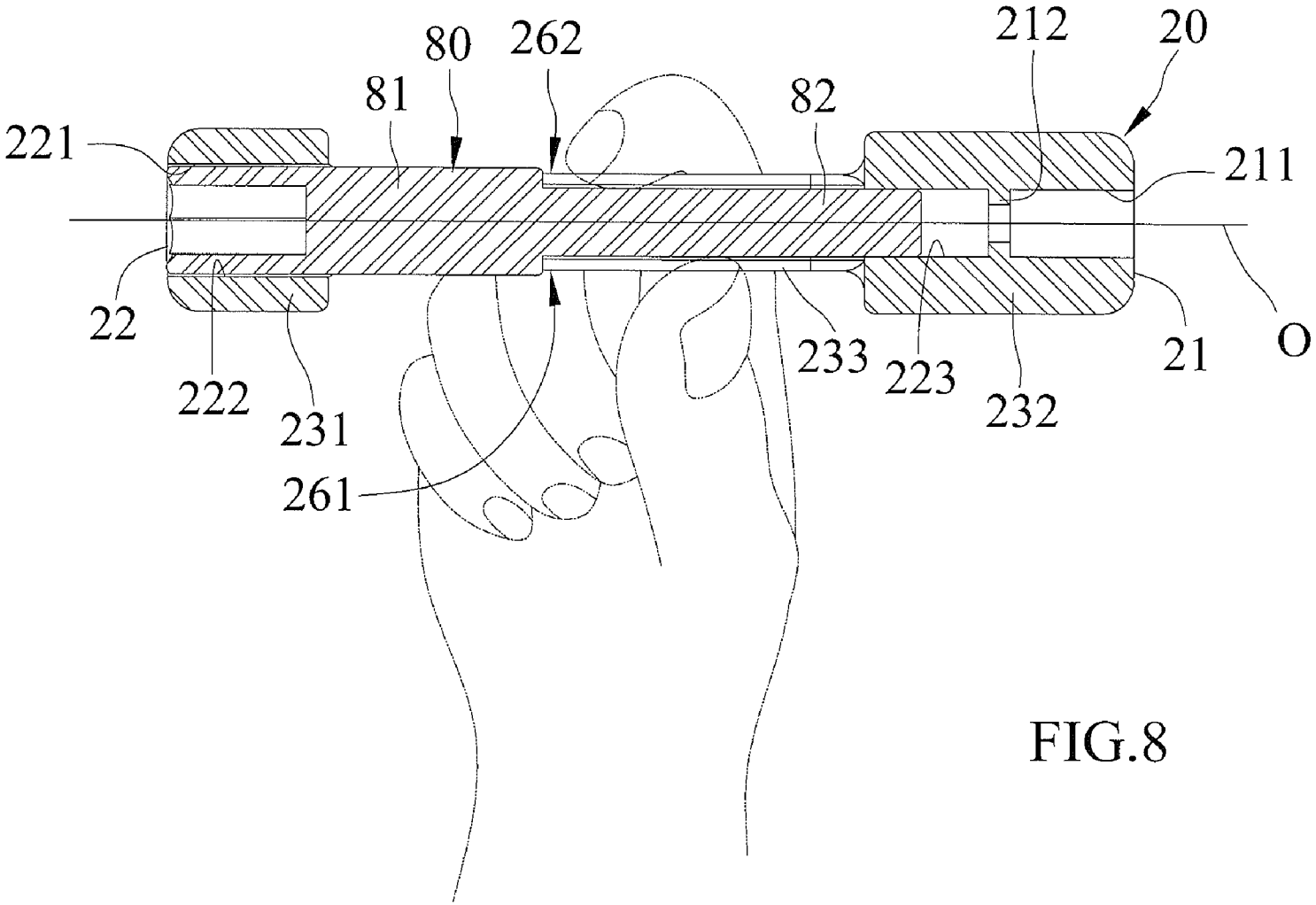
FIG. 8 shows another cross sectional view of the compact tool box of FIG. 1, illustrating removal of the shank from the insertion groove.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "axial", "lateral", "annular", "spacing", "clockwise", "counterclockwise", "length", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

With reference to FIGS. 1-9, a tool box 10 of a first embodiment according to the preferred teachings of the present invention includes a body 20, a ratcheting mechanism 30, and a rack 40.

Body 20 is substantially a parallelepiped and includes a front end 21 and a force-receiving portion 22 spaced from front end 21 in a first direction X. Body 20 further includes first and second sides 23 and 24 spaced in a second direction Y perpendicular to first direction X and extending between front end 21 and force-receiving portion 22. Body 20 further includes two lateral walls 25 spaced in a third direction Z perpendicular to first and second directions X and Y and extending between front end 21 and force-receiving portion 22 and between first and second sides 23 and 24. Lateral walls 25, front end 21 and force-receiving portion 22 are integrally formed as a single and inseparable component of the same material.

A first maximum dimension of body 20 in first direction X between front end 21 and force-receiving portion 22 defines a first spacing D1. A second maximum dimension of body 20 in second direction Y between first and second sides 23 and 24 defines a second spacing D2. A third maximum dimension of body 20 in third direction Z between lateral walls 25 defines a third spacing D3. Third spacing D3 is smaller than second spacing D2, which, in turn, is smaller than first spacing D1.

Front end 21 of body 20 includes a driving groove 211 defining a rotating axis O parallel to first direction X. Driving groove 211 has non-circular cross sections for driving a shank 80 to rotate. In this embodiment, driving groove 211 has hexagonal cross sections for engaging shank 80 with six sides. Force-receiving portion 22 is adapted to receive force applied from the palm and a part of the hand between the thumb and the index finger of a user during driving of a fastener such that the fastener can be effectively pressed against an object to be tightened. Force-receiving portion 22 includes a stepped insertion groove 221 for receiving shank 80. Stepped insertion groove 221 extends in the first direction X and is in communication with driving groove 211. A stop 212 is formed between driving groove 211 and insertion groove 221 to stop a small diameter portion 82 of shank 80.

Insertion groove 221 includes first and second sections 222 and 223. First section 222 has an opening in force-receiving portion 22. Second section 223 is in communication with driving groove 211 and has an inner diameter smaller than that of first section 222. Second section 223 is intermediate first section 222 and driving groove 211. First section 222 can receive a large diameter portion 81 of shank 80 in a storage position, and second section 223 can receive small diameter portion 82 of shank 80 in the storage position.

Body 20 includes a first opening 261 extending from one of lateral walls 25 through insertion groove 221 in the third direction Z. Body 20 further includes a second opening 262 extending from the other lateral wall 25 through insertion groove 221 in third direction Z. First and second openings 261 and 262 allow access to shank 80 in the storage position for manual removal of shank 80 from insertion groove 221 by fingers of the user. Thus, two fingers of the user can touch shank 80 at the same time to allow easy removal. In this embodiment, first and second openings 261 and 262 are in communication with first and second sections 222 and 223 of insertion groove 221 and aligned with each other. Furthermore, first opening 261 has a first length in first direction X, and second opening 262 has a length in first direction X equal to the first length of first opening 261. However, first and second openings 261 and 262 can be in communication with one of first and second sections 222 and 223.

First side 23 of body 20 includes a rounded outer face. Furthermore, first side 23 of body 20 includes first and second enclosing portions 231 and 232 in which first and second sections 222 and 223 of insertion groove 221 are respectively formed. First side 23 of body 20 further includes a spinal portion 233 interconnected between first and second enclosing portions 231 and 232. Spinal portion 233 increases the structural strength of first enclosing portion 231, avoiding damage to first enclosing portion 231 by frequent impact. Spinal portion 233 also protects shank 80 in insertion groove 221, preventing inadvertent disengagement of shank 80 due to impact by an external object. Spinal portion 233 of body 20 includes a width T in third direction Z smaller than third spacing D3. This allows the user to easily access shank 80 in insertion groove 221 via first and/or second openings 261, 262.

Since lateral walls 25, front end 21 and force-receiving portion 22 are integrally formed as a single and inseparable component of the same material, the structural strength of body 20 can be effectively enhanced. A receiving space 251 is defined between lateral walls 25 and has an opening in second side 24. Lateral walls 25 provide a large contact area for the fingers of the user such that the rotating force applied by the user can be effectively transmitted to the fastener through tool box 10. Furthermore, lateral walls 25 are symmetric to each other and, thus, suitable for both right-handed and left-handed users without limitation in the direction, allowing wider application of the product.

Rack 40 is mounted into receiving space 251 via opening 252 of body 20. Furthermore, rack 40 can be removed from body 20 via second side 24. Receiving space 251 can be sealed by rack 40 in a storage position received in receiving space 251. Rack 40 includes a mounting portion 41 facing receiving space 251 and an outer side 42 opposite to receiving space 251. Outer side 42 seals opening 252 of receiving space 251. Mounting portion 41 of rack 40 includes a plurality of bit-receiving grooves 43 for receiving bits 83. Bit-receiving grooves 43 are arranged in a single row in first direction X such that receiving space 251 of body 20 only receives a row of bits 83, effectively reducing third spacing D3 of body 20 in third direction Z and allowing easy carriage of tool box 10.

Rack 40 includes an engaging portion 45 in each of two ends thereof. Body 20 includes two engaging grooves 253 respectively in front end 21 and force-receiving portion 22 and located adjacent to second side 24. Each engaging groove 253 is in the form of a slot in this embodiment. Engaging portions 45 of rack 40 are engaged in engaging grooves 253 to prevent undesired disengagement of rack 40 from receiving space 251. However, engaging portions 45 can be manually disengaged from engaging grooves 253 to allow removal of rack 40.

Body 20 includes a first radius R1 and a second radius R2 in second direction Y and having a common rotating axis O. Specifically, first radius R1 is equal to a spacing between first side 23 of body 20 and rotating axis O in second direction Y, and second radius R2 is equal to a spacing between second side 24 of body 20 and rotating axis O in second direction Y. Second spacing D2 is equal to the sum of first radius R1 and second radius R2. Furthermore, second radius R2 is larger than first radius R1. First radius R1 is smaller than third spacing D3.

Since second radius R2 is larger than first radius R1, the arm of force for rotating tool box 10 about rotating axis O is increased, obtaining force-saving driving effect. Furthermore, since first radius R1 is smaller than third spacing D3, tool box 10 can be utilized in a limited space such as a corner of a wall. Preferably, first radius R1 is not larger than a half of third spacing D3. Thus, tool box 10 can be rotated through a large angle in a limited space such as a corner of a wall.

Driving groove 211 is located in a quarter corner of body 20 adjacent to front end 21 and first side 23. The "quarter corner" of body 20 is an area within a half of first spacing D1 starting from front end 21 and within a half of second spacing D2 starting from first side 23. This arrangement allows tool box 10 to provide the maximum force-saving effect while having the minimized volume. This arrangement also allows tool box 10 to be used in a corner of a wall.

Rotating axis O of tool box 10 lies in a plane P perpendicular to third direction Z. Plane P equally divides third spacing D3. Namely, plane P is located in a center of third spacing D3. Specifically, rotating axis O has equal spacing to lateral walls 25 in third direction Z. Thus, that the force rotating tool box 10 can be equally distributed to lateral walls 25. Since lateral walls 25 are on opposite sides of and symmetric relative to rotating axis O, no stress concentration will occur at either lateral wall 25.

Figure 9:
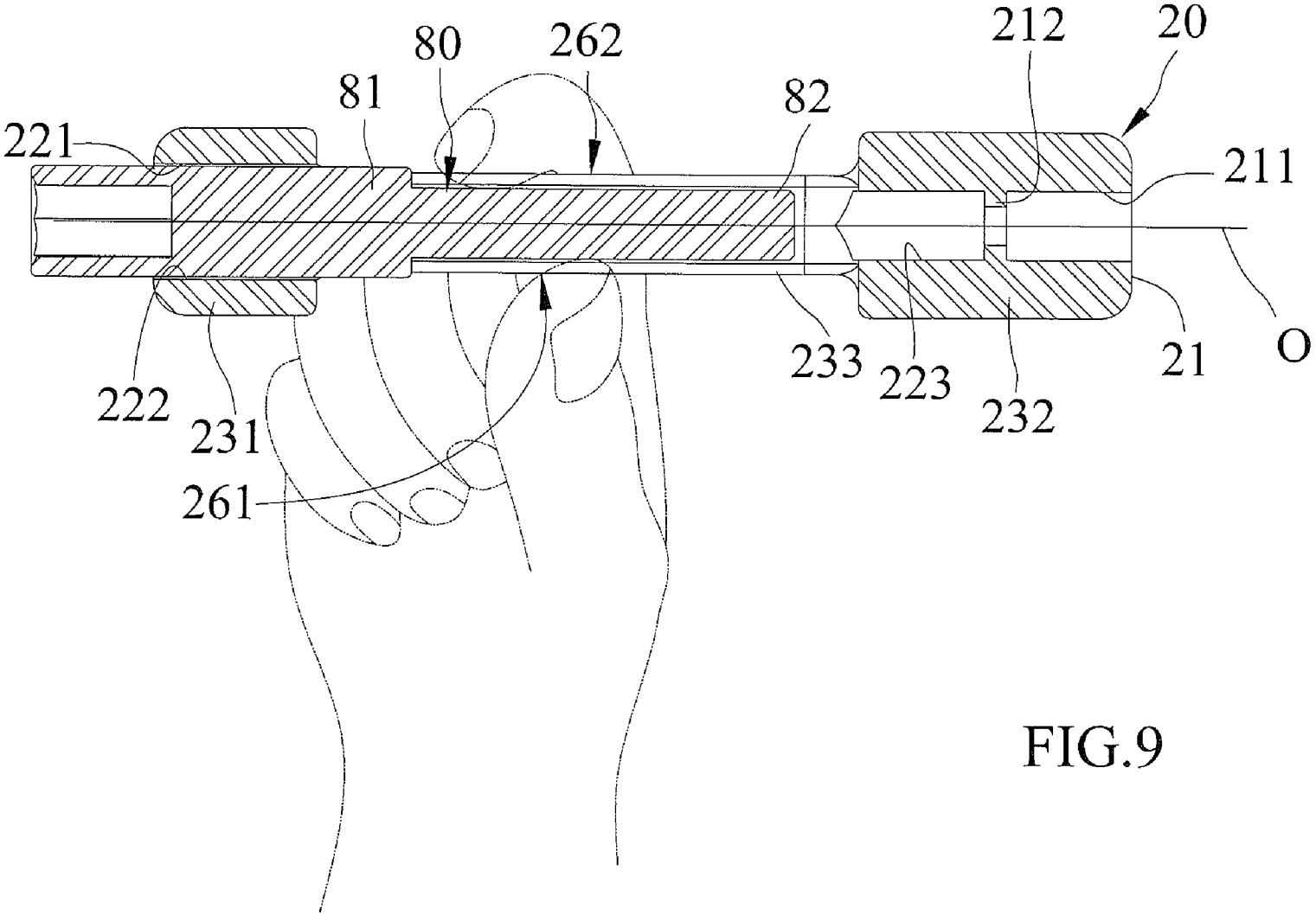
FIG. 9 shows a cross sectional view similar to FIG. 8 with a smaller diameter portion of the shank disengaged from a section of an insertion groove.

FIGS. 6-9 show removal of rack 40 from body 20. The user can see whether shank 80 is in tool box 10 via first or second opening 261, 262, which is more convenient than conventional tool boxes that have to be opened to achieve the same purpose. Since width T of spinal portion 233 is smaller than third spacing D3, the fingers of the user can easily and smoothly reach shank 80 in insertion groove 221 via first and/or second openings 261, 262 without obstacle, as shown in FIG. 9. Time is saved in accessing shank 80, as unnecessary steps or movement is not required.

Figure 10:
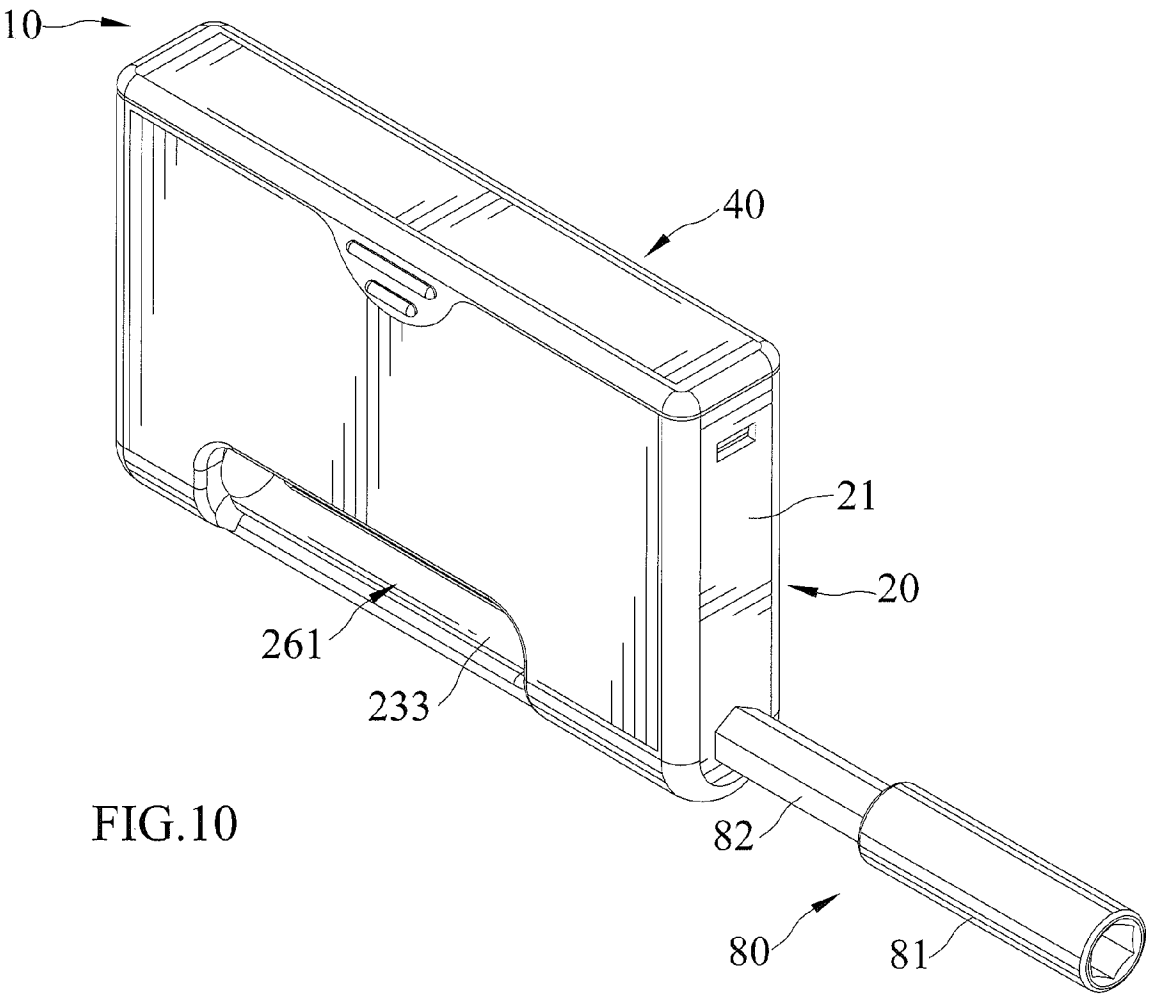
FIG. 10 shows a perspective view of the compact tool box with the shank in an operative position.

With reference to FIG. 10, when it is desired to proceed with driving operation, smaller diameter portion 82 of shank 80 is inserted into driving groove 211. Rack 40 is removed from body 20 by disengaging engaging portions 45 from engaging grooves 253. The user can pick the desired bit 83. Since lateral walls 25 are symmetric to each other, tool box 10 according to the preferred teachings of the present invention is suitable for both right-handed and left-handed users without limitation in the direction, allowing wider application of the product, as mentioned above.

Since driving groove 211 is located in the quarter corner adjacent to front end 21 and first side 23 of body 20 and since second radius R2 is larger than first radius R1, lateral walls 25 can effectively increase the arm of force during rotation of tool box 10, obtaining the best force-saving effect. Furthermore, since first radius R1 is smaller than third spacing D3, first side 23 be close to a corner of the wall during rotation of tool box 10, allowing use of tool box 1 in a limited space.

When not in use, shank 80 is removed from an operative position in driving groove 211 and inserted into insertion groove 221 of tool box 10.

Figure 11:
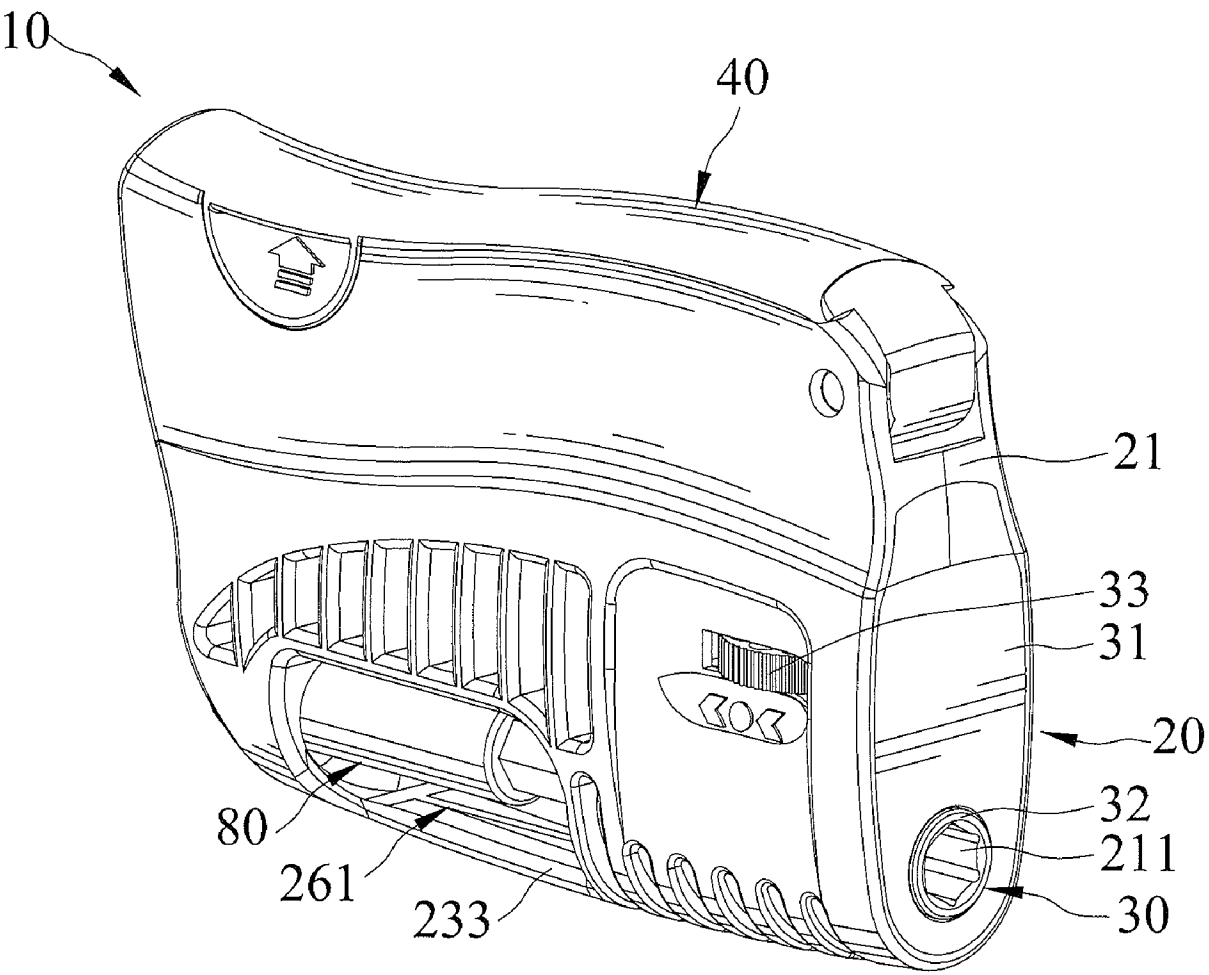
FIG. 11 shows a perspective view of a compact tool box of a second embodiment according to the preferred teachings of the present invention.
Figure 12:
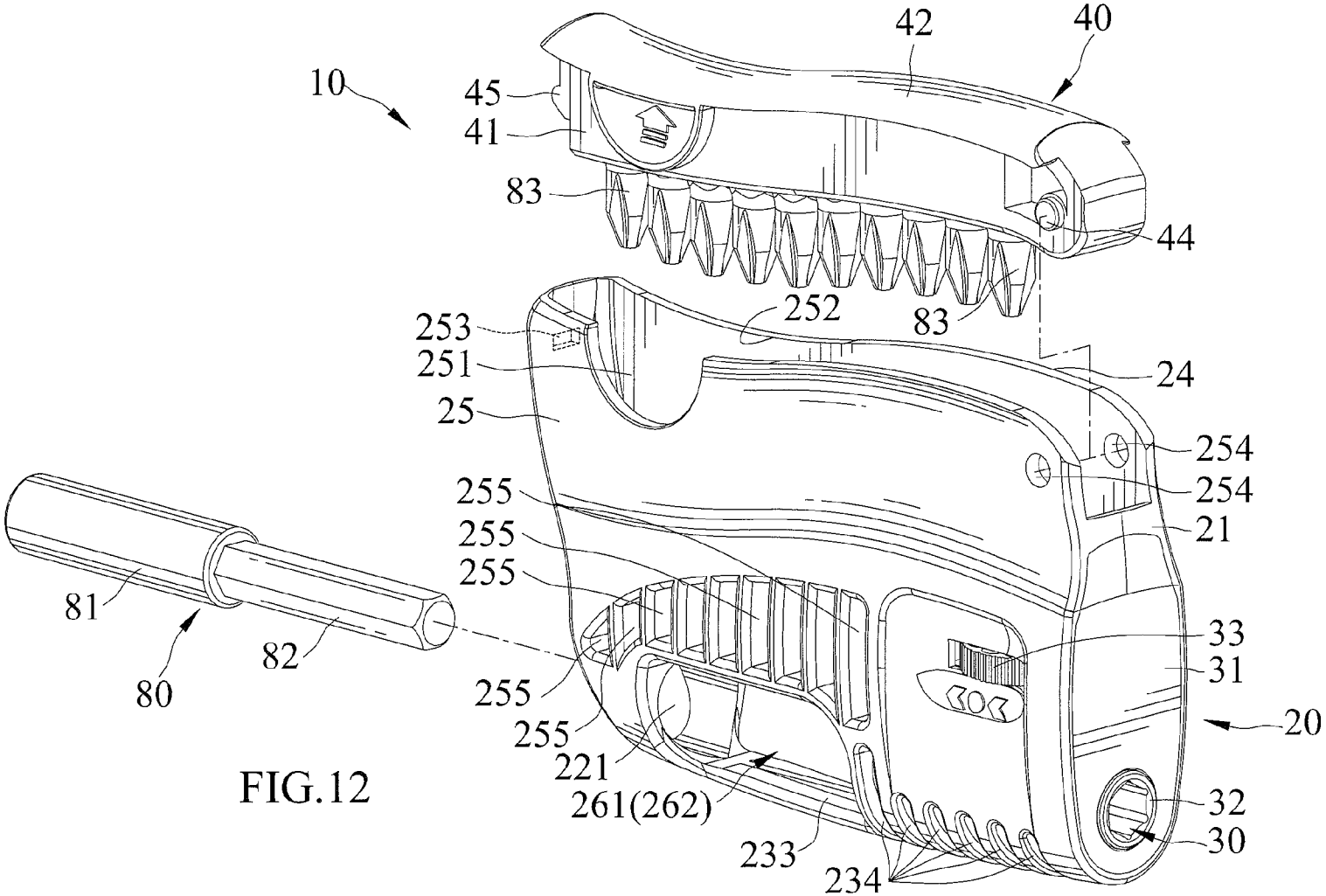
FIG. 12 shows an exploded, perspective view of the compact tool box of FIG. 11.
Figure 13:
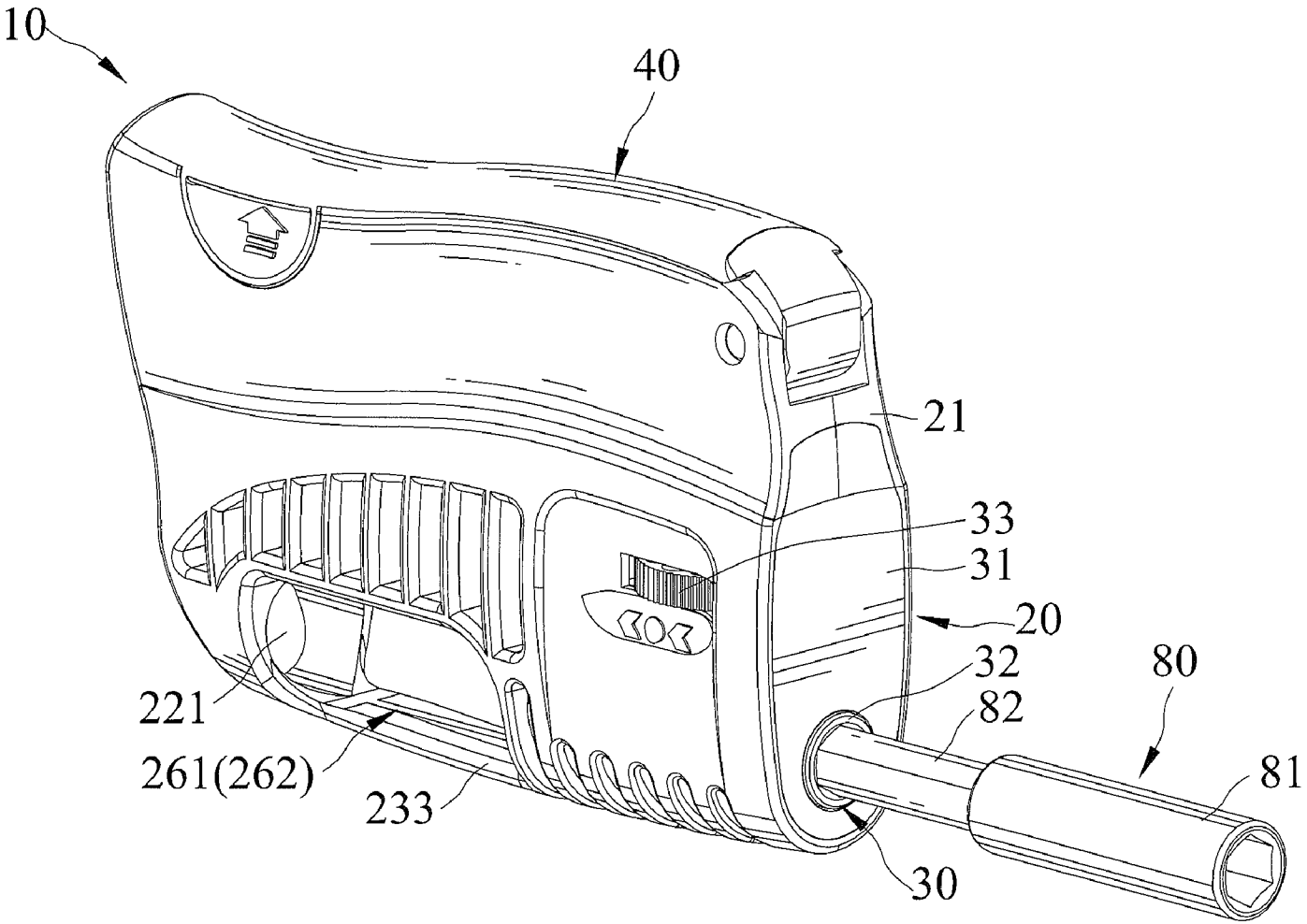
FIG. 13 shows a perspective view of the compact tool box of FIG. 11 with a shank in an operative position.

FIGS. 11-13 show a tool box 10 of a second embodiment according to the preferred teachings of the present invention. The second embodiment is substantially the same as the first embodiment except that a ratcheting mechanism 30 is mounted in body 20 and that rack 40 is engaged with body 20 in a different way.

Specifically, ratcheting mechanism 30 includes a main body 31, a hollow ratchet wheel 32 rotatably received in main body 31, and a switch device 33 for controlling ratchet wheel 32 to be rotatable in a clockwise or counterclockwise direction or to be not rotatable in either of the clockwise and counterclockwise directions.

Ratchet wheel 32 is mounted in front end 21 of body 20 and rotatable about rotating axis O. Ratchet wheel 32 has an end exposed at front end 21 of body 20. Driving groove 211 is formed in the exposed end of ratchet wheel 32. Switch device 33 is mounted between body 31 and ratchet wheel 32 and exposed via one or both of lateral walls 25 for manual operation by the user.

Rack 40 is pivotably mounted to body 20. Specifically, rack 40 includes two lateral sides extending between mounting portion 41 and outer side 42. A pin 44 is formed on each of the lateral sides of rack 40. Each lateral wall 25 includes a pivotal hole 254. Pins 44 of rack 40 are pivotably received in pivotal holes 254 of lateral walls 25. Rack 40 further includes an engaging portion 45 on an end thereof adjacent to force-receiving portion 22. Body 20 includes an engaging groove 253 in the form of a slot. Engaging portion 45 of rack 40 is engaged in engaging groove 253 when rack 40 is in the storage position to prevent inadvertent disengagement of rack 40 from receiving space 251 of body 20. It can be appreciated that rack 40 can always be retained on body 20 without the risk of lost of rack 40 and bits 83 carried by rack 40.

Furthermore, a plurality of plurality of recesses 255 is formed on an outer face of at least one of lateral walls 25 and spaced in first direction X at regular intervals and located adjacent to first and second openings 261 and 262. Recesses 255 have rectangular cross sections. Recesses 255 and protrusions between recesses 255 provide increased friction between the fingers of the user and lateral walls 25 while providing an aesthetically pleasing effect.

Further, first side 23 of body 20 includes a plurality of grooves 234 formed on an outer face of first side 23 and located between front end 21 and first opening 261 (or second opening 262) and spaced in first direction X at regular intervals. In this embodiment, grooves 234 are formed on an outer face of second enclosing portion 232 and are arcuate. Grooves 234 and protrusions between grooves 234 provide increased friction between the fingers of the user and first side 23 while providing an aesthetically pleasing effect.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A tool box comprising:

a body including a front end and a force-receiving portion spaced from the front end in a first direction, with the body further including first and second sides spaced in a second direction perpendicular to the first direction, with the body further including first and second lateral walls spaced in a third direction perpendicular to the first and second directions and extending between the front end and the force-receiving portion, with the front end including a driving groove, with the driving groove adapted to receive a shank in an operative position, with the force-receiving portion including an insertion groove extending in the first direction, with the insertion groove adapted to receive the shank in a storage position, with the insertion groove in communication with the driving groove of the body, with the body including a first opening extending from the first lateral wall through the insertion groove in the third direction, with the body further including a second opening extending from the second lateral wall through the insertion groove in the third direction, with the first and second openings allowing access to the shank in the storage position for manual removal of the shank from the insertion groove by fingers of a user, with a receiving space defined between the first and second lateral walls and having an opening; and a rack removably received in the receiving space of the body via the opening, with the rack adapted to receive a plurality of bits.

2. The tool box as claimed in claim 1, with the insertion groove including first and second sections, with the first section having an opening in the force-receiving portion, with the second section in communication with the driving groove and located intermediate the first section and the driving groove, with the first section having an inner diameter, with the second section having an inner diameter smaller than the inner diameter of the first section, with the shank including a large diameter portion and a small diameter portion, with the first and second sections respectively receiving the large and small diameter portions of the shank in the storage position, with the first side of the body including first and second enclosing portions, with the first and second sections of the insertion groove respectively formed in the first and second enclosing portions, with the first side of the body further including a spinal portion interconnected between the first and second enclosing portions.

3. The tool box as claimed in claim 1, with a first maximum dimension of the body in the first direction between the front end and the force-receiving portion defining a first spacing, with a second maximum dimension of the body in the second direction between the first and second sides defining a second spacing, with a third maximum dimension of the body in the third direction between the first and second lateral walls defining a third spacing, with the spinal portion of the body including a width in the third direction smaller than the third spacing.

4. The tool box as claimed in claim 3, with the first opening in communication with the second section of the insertion groove.

5. The tool box as claimed in claim 4, with the second opening in communication with the second section of the insertion groove.

6. The tool box as claimed in claim 5, with the first opening having a first length in the first direction, with the second opening having a length in the first direction equal to the first length of the first opening.

7. The tool box as claimed in claim 5, with a plurality of plurality of recesses formed on an outer face of at least one of the first and second lateral walls and spaced in the first direction and located adjacent to the first and second openings, with the first side of the body further including a plurality of grooves formed on an outer face of the second enclosing portion and spaced in the first direction.

8. The tool box as claimed in claim 4, with the third spacing smaller than the second spacing, with the second spacing smaller than the first spacing, with the body having a first radius and a second radius in the second direction and having a common rotating axis, with the first radius equal to a spacing between the first side of the body and the rotating axis in the second direction, with the second radius equal to a spacing between the second side of the body and the rotating axis in the second direction, with the second spacing equal to a sum of the first radius and the second radius, with the second radius larger than the first radius, with the first radius not larger than a half of the third spacing, with the rotating axis having equal spacing to the first and second lateral walls in the third direction.

9. The tool box as claimed in claim 8, with the rack including a mounting portion facing the receiving space and an outer side opposite to the receiving space, with the outer side sealing the opening of the receiving space, with the mounting portion of the rack including a plurality of bit-receiving grooves for receiving the bits, with the bit-receiving grooves arranged in a single row in the first direction.

10. The tool box as claimed in claim 9, with the rack including an engaging portion in each of two ends thereof, with the body including two engaging grooves respectively in the front end and the force-receiving portion and located adjacent to the second side, with the engaging portions of the rack releasably engaged in the two engaging grooves of the body.

11. The tool box as claimed in claim 9, with the rack further including two lateral sides extending between the mounting portion and the outer side, with a pin formed on each of the two lateral sides of the rack, with each of the first and second lateral walls including a pivotal hole, with the pins of the rack pivotably received in the pivotal holes of the first and second lateral walls, with the rack further including an engaging portion on an end thereof adjacent to the force-receiving portion, with the body including an engaging groove, with the engaging portion of the rack engaged in the engaging groove when the rack is in the storage position.

12. The tool box as claimed in claim 1, with a plurality of plurality of recesses formed on an outer face of at least one of the first and second lateral walls and spaced in the first direction and located adjacent to the first and second openings, with the body further including a plurality of grooves formed on an outer face of the first side and located between the first opening and the front end and spaced in the first direction.

* * * * *